US010656599B2

(12) United States Patent
Momose

(10) Patent No.: US 10,656,599 B2
(45) Date of Patent: May 19, 2020

(54) ELECTRONIC TIMEPIECE

(71) Applicant: SEIKO EPSON CORPORATION, Tokyo (JP)

(72) Inventor: Yasuhiro Momose, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 142 days.

(21) Appl. No.: 15/919,658

(22) Filed: Mar. 13, 2018

(65) Prior Publication Data

US 2018/0275610 A1 Sep. 27, 2018

(30) Foreign Application Priority Data

Mar. 23, 2017 (JP) ..... 2017-057846

(51) Int. Cl.

| | |
|---|---|
| ***G04B 47/06*** | (2006.01) |
| ***G04G 21/02*** | (2010.01) |
| ***G04G 9/00*** | (2006.01) |
| *G04B 19/04* | (2006.01) |
| *G04B 47/00* | (2006.01) |

(52) U.S. Cl.

CPC ..... *G04B 47/061* (2013.01); *G04G 9/0064* (2013.01); *G04G 21/02* (2013.01); *G04B 19/04* (2013.01); *G04B 47/008* (2013.01)

(58) Field of Classification Search

CPC ..... G04B 47/06; G04B 47/061; G04B 47/00; G04B 47/008; G04B 19/04; G04G 21/02; G04G 9/0064

See application file for complete search history.

(56) References Cited

U.S. PATENT DOCUMENTS

| | | | | |
|---|---|---|---|---|
| 8,243,553 | B2 * | 8/2012 | Veuthey | G04G 21/02 368/11 |
| 2010/0331145 | A1 * | 12/2010 | Lakovic | G04F 10/00 482/8 |
| 2015/0153712 | A1 * | 6/2015 | Peters | G04C 23/06 368/80 |
| 2019/0041804 | A1 * | 2/2019 | Takyoh | G04C 3/143 |

FOREIGN PATENT DOCUMENTS

JP 2013-057517 A 3/2013

* cited by examiner

*Primary Examiner* — Sean Kayes
(74) *Attorney, Agent, or Firm* — Oliff PLC

(57) ABSTRACT

An electronic timepiece includes a measurement unit which is measuring a predetermined measurement item, a storage unit which stores measurement result information in which a measurement result obtained by the measurement unit is associated with a measurement time when the measurement result is obtained, and a display unit which displays the measurement result and the measurement time by hands.

13 Claims, 11 Drawing Sheets

| LOG NUMBER | MEASUREMENT DATE AND TIME | MEASUREMENT RESULT |
|---|---|---|
| 1 | 2017/03/31 8:05 | 2725 |
| 2 | 2017/03/31 7:12 | 2700 |
| 3 | 2017/03/30 15:08 | 2712 |
| ... | ... | ... |
| 10 | 2017/03/28 15:35 | 2650 |
| 11 | 2017/03/28 10:00 | 2600 |

| LOG NUMBER | MEASUREMENT DATE AND TIME | MEASUREMENT RESULT |
|---|---|---|
| 1 | 2017/03/31 9:00 | 2650 |
| 2 | 2017/03/31 8:05 | 2725 |
| 3 | 2017/03/31 7:12 | 2700 |
| ... | ... | ... |
| 10 | 2017/03/28 16:58 | 2665 |
| 11 | 2017/03/28 15:35 | 2650 |

ELECTRONIC TIMEPIECE

CROSS-REFERENCE TO RELATED APPLICATION

This nonprovisional application claims the benefit of Japanese Patent Application No. 2017-057846 filed Mar. 23, 2017, the enter disclosure which is incorporated herein by reference.

BACKGROUND

1. Technical Field

The present invention relates to an electronic timepiece.

2. Related Art

In recent years, there has been known an electronic timepiece that indicates the present time by hour and minute hands, measures a physical quantity such as a temperature, and indicates the measured physical quantity by an information pointer (for example, see JP-A-2013-57517).

The electronic timepiece disclosed in JP-A-2013-57517 includes a temperature sensor that detects an outside air temperature and a temperature sensor control unit that controls electrification and the cycle of measurement of the temperature sensor to perform temperature measurement, in addition to a configuration for clocking the present time. In the electronic timepiece, a time is indicated by the hour hand and the minute hand which are rotated in the entire dial plate with the center of the dial plate as an axis. In addition, the temperature measured by the temperature sensor is indicated by a short hand positioned at a scale part provided at the position of 9 o'clock of the dial plate.

Here, in the electronic timepiece disclosed in JP-A-2013-57517, a temperature which is a measured value of the temperature sensor is indicated by the short hand during the measurement of the temperature. On the other hand, there has been a demand for a configuration in which a measured value can be referred to at a later timing.

However, there is a problem in that only the display of the past measured value does not make it possible to determine that the displayed measured value corresponds to a measured value indicating at what timing the measured value is stored.

SUMMARY

An advantage of some aspects of the invention is to provide an electronic timepiece ascertaining a measurement result and a measurement time.

An electronic timepiece according to a first aspect of the invention includes a measurement unit which is measuring a predetermined measurement item, a storage unit which stores measurement result information in which a measurement result obtained by the measurement unit is associated with a measurement time when the measurement result is obtained, and a display unit which displays the measurement result and the measurement time by hands.

Meanwhile, the measurement time may be a time which is a timing when the measurement result is obtained by the measurement unit, or may be a time which is a timing when the measurement unit performs measurement.

According to the aspect, the storage unit stores the measurement result and the measurement time when the measurement result is obtained. For this reason, it is possible to display not only the measurement result obtained by the measurement unit but also the measurement time by the hands of the display unit at a timing after the measurement time. Therefore, even when the measurement result is confirmed later, a user can ascertain the measurement time of the measurement result.

In the electronic timepiece, it is preferable that the hands include a hour hand and a minute hand which indicate the measurement time, and a pointer which is provided separately from the hour hand and the minute hand and indicates the measurement result.

With such a configuration, the hour hand and the minute hand are provided separately from the pointer, and thus it is possible to simultaneously ascertain the measurement time and the measurement result.

In the electronic timepiece, it is preferable that the electronic timepiece further includes a storage control unit which stores the measurement result information in the storage unit when a storage operation for storing the measurement result information is performed.

With such a configuration, the measurement result information is stored in a case where the storage operation is performed, and thus the storage unit does not need to store all measurement results. Therefore, it is possible to reduce the storage capacity of the storage unit and to reduce the manufacturing cost of the electronic timepiece.

In the electronic timepiece, it is preferable that the storage control unit stores the measurement result information in the storage unit together with a storage number indicating the order of storage of the measurement result information by the storage unit.

With such a configuration, it is possible to rapidly execute the read-out of measurement result information from the storage unit on the basis of the storage number. Therefore, it is possible to reduce a time from when a display operation for displaying the measurement result information is performed to when the measurement result information is displayed.

In the electronic timepiece, it is preferable that the storage control unit stores the measurement result information, which is newly acquired, in the storage unit together with the latest storage number when the storage operation is performed, and performs any one of moving-up and moving-down of the storage number associated with the measurement result information which is stored in the storage unit in advance.

With such a configuration, it is possible to arrange the storage numbers in order of storage of the measurement result information. Therefore, it is possible to efficiently refer to and display the measurement result information in a case where the storage number is designated to display the measurement result information or a case where the measurement result information is displayed in order of the storage numbers.

In the electronic timepiece, it is preferable that the electronic timepiece further includes a display control unit which displays the measurement result information associated with the storage number, which is designated through the display operation, on the display unit when a display operation for displaying the measurement result information is performed.

With such a configuration, it is possible to display the measurement result information associated with the storage number by designating the storage number. Therefore, it is possible to make it easy to designate measurement result information that the user desires to refer to and to improve the convenience of the electronic timepiece.

In the electronic timepiece, it is preferable that the display unit includes a number hand indicating the storage number.

With such a configuration, the user can confirm the designated storage number when the measurement result information is displayed. Therefore, it is possible to improve the convenience of the electronic timepiece.

In the electronic timepiece, it is preferable that the electronic timepiece further includes a control unit which indicates the measurement result associated with the measurement time by the pointers in a case where a time indicated by the hour hand and the minute hand is consistent with the measurement time stored in the storage unit, when a time operation for changing positions of the hour hand and the minute hand is performed.

With such a configuration, the measurement result, which is stored in association with the time indicated by the hour hand and the minute hand of which the positions are changed by the user, is indicated by the pointer. Accordingly, it is possible to make it easy to ascertain a change in the measurement result. For example, in a case where the storage of the measurement result in the storage unit is performed a plurality of times for an hour, it is possible to make it easy to ascertain a change in the measurement result by moving the minute hand. In addition, in a case where the storage is performed a plurality of times in a day, it is possible to make it easy to ascertain a change in the measurement result by moving the hour hand. Therefore, it is possible to improve the convenience of the electronic timepiece.

In the electronic timepiece, it is preferable that the electronic timepiece further includes a driving unit which moves the hour hand and the minute hand in accordance with the time operation, in which the electronic timepiece is configured to be switching an operation mode to a reference mode in which the measurement result information stored in the storage unit is referred to and a basic mode in which a present time is displayed, and in which the driving unit moves the hour hand and the minute hand at a movement speed higher than movement speeds of the hour hand and the minute hand in a case where the time operation is performed in the basic mode, when the time operation is performed in the reference mode being the operation mode.

Meanwhile, examples of the driving unit may include not only a motor but also an actuator such as a piezoelectric element.

With such a configuration, the positions of the hour hand and the minute hand can be easily changed by the driving unit, and thus it is possible to easily designate the measurement time, as compared to a case where a measurement time of measurement result information to be referred to is designated through an operation such as the turning of a crown.

In addition, the movement of the hour hand and the minute hand in a case where the operation mode of the electronic timepiece is the reference mode is performed at a movement speed higher than that in the basic mode. For this reason, the designation of the measurement time can be rapidly performed, and thus it is possible to more rapidly display the measurement result that the user desires to refer to. In addition, the measurement result is displayed in accordance with the movement of the hour hand and the minute hand, and thus it is possible to make it easy to ascertain a change in the measurement result.

Alternatively, in the electronic timepiece, it is preferable that the electronic timepiece further includes a driving unit which moves the hour hand and the minute hand in accordance with the time operation, in which the driving unit increases movement speeds of the hour hand and the minute hand as the time indicated by the hour hand and the minute hand goes back to the past.

Meanwhile, examples of the driving unit may include a motor and an actuator such as a piezoelectric element, as described above.

With such a configuration, in a case where a relatively old measurement result is referred to, it is possible to make it easy to match the hour hand and the minute hand to a measurement time associated with the measurement result. Therefore, it is possible to more rapidly display the measurement result that the user desires to refer to, and to improve the convenience of the electronic timepiece.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of the invention will be described with reference to the accompanying drawings.

External Configuration of Electronic Timepiece

Figure 1:
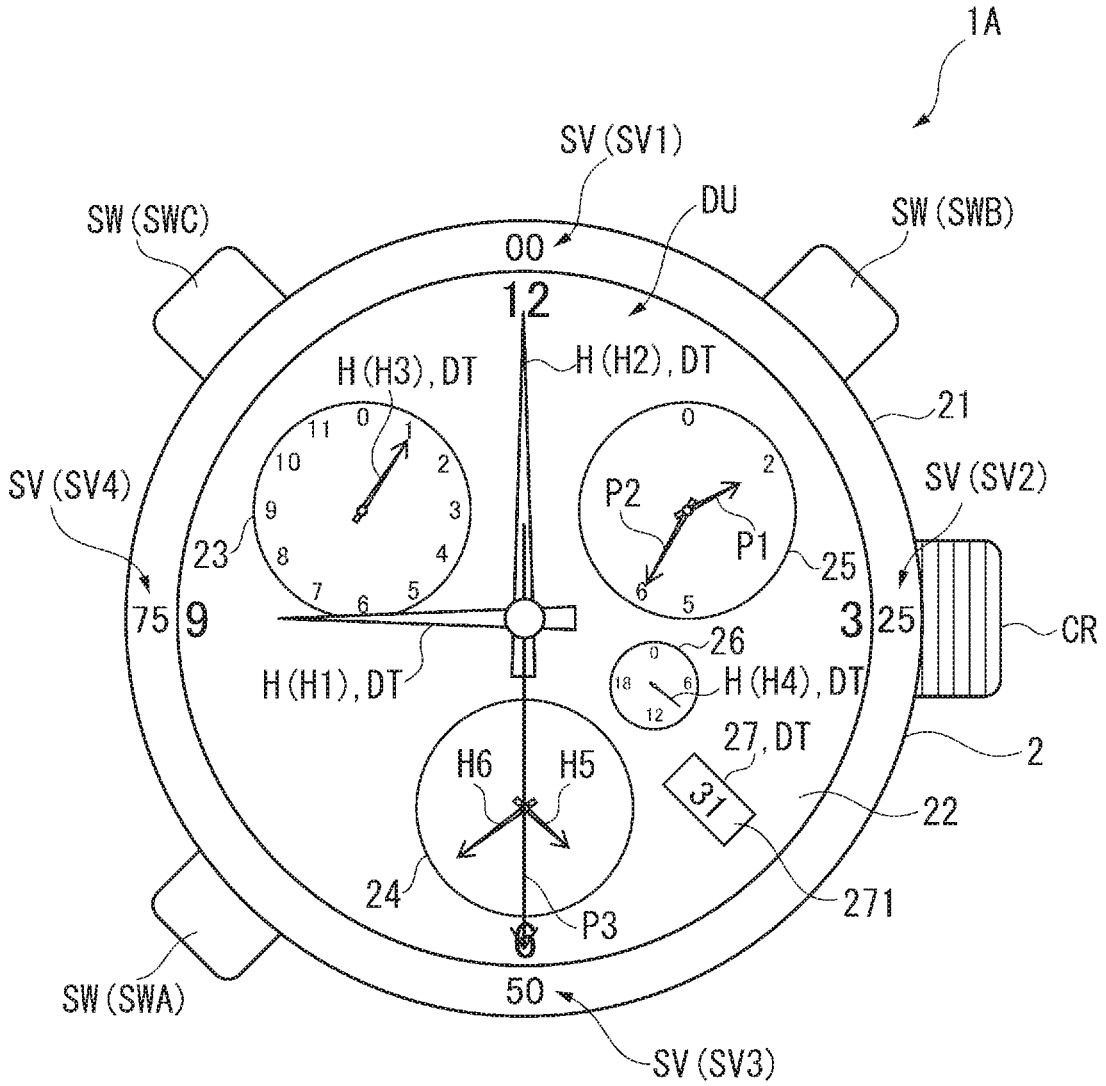
FIG. 1 is a front view showing an electronic timepiece according to a first embodiment of the invention.

FIG. 1 is a front view showing an electronic timepiece 1A according to this embodiment.

The electronic timepiece 1A according to this embodiment is an wearable apparatus which is configured to be portable and used by a user and to be worn on the user, and is an analog type electronic timepiece which indicates the present date and time and a measurement result obtained by a sensor by hands, as shown in FIG. 1. The electronic timepiece 1A (hereinafter, may be simply referred to as the timepiece 1A) includes a timepiece body 2 and a band (not shown) that makes the timepiece body 2 is worn on the user's body (for example, the wrist).

Configuration of Timepiece Body

The timepiece body 2 includes a housing 21 and a dial 22 which have a substantially cylindrical shape when seen in a front view.

Scale values SV (SV1 to SV4) are written in a peripheral edge on the front side in the housing 21. Specifically, the scale value SV1 of "00" is written at a position in the direction of 0 o'clock in the peripheral edge, and the scale value SV2 of "25" is written at a position in the direction of 3 o'clock. In addition, the scale value SV3 of "50" is written at a position in the direction of 6 o'clock, and the scale value SV4 of "75" is written at a position in the direction of 9 o'clock. The scale values SV1 to SV4 are scale values when values of "00" to "99" are shown by a pointer P3 in a case where an operation mode of the timepiece 1A is set to be a reference mode to be described later.

The dial 22 constitutes a display unit DU of the timepiece 1A. The dial 22 is formed to have a cylindrical shape and is disposed within the housing 21. The dial 22 includes four small windows 23 to 26, a date display unit 27, time display hands H (hour hands H1 and H4, a minute hand H2, and a second hand H3), a mode display hand H5, a remaining quantity display hand H6, and pointers P1 to P3.

Among these, the hour hands H1 and H4, the minute hand H2, and the date display unit 27 are set to be a date and time display unit DT.

The hour hand H1 and the minute hand H2 are rotatably provided such that the respective turning shafts are formed coaxially with each other at substantially the center of the dial 22.

The small window 23 is positioned in a direction of substantially 10 o'clock in the dial 22. The second hand H3 is rotatably disposed in the small window 23. The second hand H3 also functions as a number hand indicating a log number to be described later.

The small window 24 is positioned in a direction of substantially 6 o'clock in the dial 22. The mode display hand H5 and the remaining quantity display hand H6 are rotatably disposed in the small window 24 so that the respective turning shafts are formed coaxially with each other at substantially the center of the small window 24. Among these, the mode display hand H5 is a hand indicating the present operation mode of the timepiece 1A, and the remaining quantity display hand H6 is a hand indicating a battery remaining quantity of a secondary battery (not shown) built into the housing 21.

The small window 25 is disposed at a position in a direction of substantially 2 o'clock in the dial 22. The pointers P1 and P2 are rotatably disposed in the small window 25 so that the respective turning shafts are formed coaxially with each other. Among these, the pointer P2 is formed longer than the pointer P1.

The pointer P3 is rotatably provided in the dial 22 so that the turning shaft thereof is formed coaxially with those of the hour hand H1 and the minute hand H2.

Meanwhile, the timepiece 1A can indicate numerical values of four digits by the pointers P1 to P3 when showing a measurement result obtained by a measurement unit 33 to be described later. In this embodiment, among the numerical values of four digits, the numerical value for the high-order first digit (for example, the numerical value for the thousand's digit) is indicated by the pointer P1, the numerical value for the high-order second digit (for example, the numerical value for the hundred's digit) is indicated by the pointer P2, and the numerical values for the high-order third digit and the fourth digit (for example, the numerical values for the ten's digit and the one's digit) are indicated by the pointer P3. This is the same as in a case where numerical values after the decimal point are shown. That is, the pointers P1 and P2 indicate a value of "0" to "1", and the pointer P3 indicates a value of "00" to "99".

The small window 26 is disposed at a position close to the center in the dial 22 in a direction of substantially 4 o'clock in the dial 22. In the small window 26, the hour hand H4 is rotatably provided. The hour hand H4 is a 24-hour hand indicating the hour (hour in the hour and the minute) in the present date and time by a 24-hour scale.

The date display unit 27 is positioned on the peripheral edge side in the dial 22 in a direction of substantially 4 o'clock in the dial 22. The date display unit 27 is a display unit indicating the date in the present date and time, and includes a day wheel 271 having the date is written therein.

The housing 21 includes three switches SW (SWA to SWC) provided on the side surface of the housing 21 so as to protrude and one crown CR.

The switches SWA to SWC are disposed at positions in a direction of substantially 8 o'clock, a direction of substantially 10 o'clock, and a direction of substantially 2 o'clock. The switches SWA to SWC output operation signals based on an input operation (pressing-down operation) by a user to a control unit 37 to be described later.

For example, the switches SWB and SWC output an operation signal for changing an operation mode of the timepiece 1A. As the operation mode, a basic mode, an in-flight mode, a measurement mode, and a reference mode are set in the timepiece 1A.

Among these, the basic mode is a mode for receiving radio waves (for example, date and time information to be described later) from the outside in addition to displaying the present date and time. The in-flight mode is an operation mode which is used within an airplane, and is a mode in which the reception of radio waves is restricted. The measurement mode is a mode for displaying a measurement result obtained by the measurement unit 33 to be described later, and the reference mode is a mode in which measurement result information including a measurement result and a measurement date and time recorded as logs can be referred to.

In this embodiment, when the switch SWC is input, the operation mode of the timepiece 1A is switched to the measurement mode by a control unit 37 to be described later. In the measurement mode, when the switch SWC is input by an input mode such as long press, measurement result information including a measurement result obtained by the measurement unit 33 and a measurement date and time which is a date and time when the measurement result is obtained is stored together with log numbers. The log numbers are numbers allocated in order of the storage of the measurement result information, and log number 1 is set in the latest measurement result information. That is, in a case where new measurement result information is stored, the log number of the measurement result information stored in advance is moved up by 1.

On the other hand, the switch SWB is input, the operation mode of the timepiece 1A is switched to the reference mode. In the reference mode, when the switch SWB is further input, the log number of the measurement result information to be referred to is moved up by 1 in accordance with the number of times of input of the switch SWB. For this reason, the measurement result information of the log number 1 is referred to immediately after a change to the reference mode is made, and measurement result information of log number 2 is referred to when the switch SWB is further input. The log number is indicated by the second hand H3 that functions as a number hand, and measurement result information associated with the log number is indicated by the pointers P1 to P3.

The crown CR is disposed at a position in a direction of 3 o'clock on the side surface of the housing 21. It is possible to rotate the hour hands H1 to H4 by operating the crown CR.

Internal Configuration of Timepiece

Figure 2:
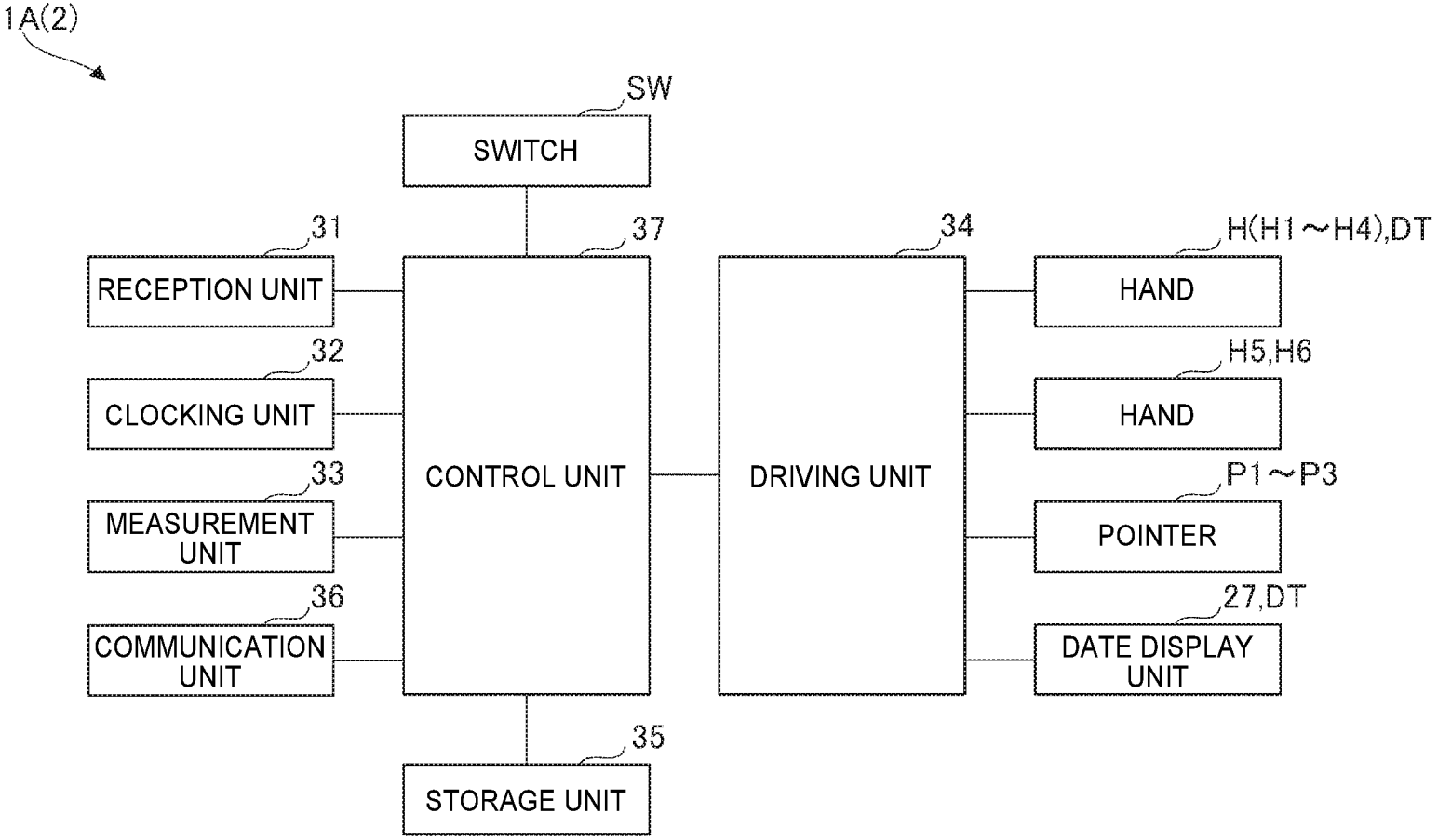
FIG. 2 is a block diagram showing the internal configuration of the electronic timepiece in the first embodiment.

FIG. 2 is a block diagram showing the internal configuration of the timepiece 1A.

The timepiece 1A includes a reception unit 31, a clocking unit 32, a measurement unit 33, a driving unit 34, a storage unit 35, a communication unit 36, and a control unit 37 as shown in FIG. 2, in addition to the above-described configuration. Although not shown in the drawing, the timepiece 1A includes a secondary battery that supplies a driving power to the timepiece body 2, a power generation unit, such as a solar panel, which generates power for charging the secondary battery, and a charging unit that charges the secondary battery with the power generated by the power generation unit.

The reception unit 31 is constituted by a module that receives date and time information included in a satellite signal, such as a Global Positioning System (GPS) signal, standard radio waves, or the like under the control of the control unit 37. Meanwhile, the reception of the date and time information by the reception unit 31 may be performed in a case where the switch SW (for example, the switch SWA) is pressed down or may be performed at a preset time.

The clocking unit 32 clocks the present date and time. The present date and time is corrected by the control unit 37 to be described later on the basis of the date and time information received by the reception unit 31.

The measurement unit 33 measures information regarding the user's body and body motion or information regarding the surrounding environment of the timepiece 1A. Although not shown in the drawing, in this embodiment, the measurement unit 33 includes sensors that respectively measure atmospheric pressure and orientation, and atmospheric pressure, altitude, and orientation are measured by the sensors. The measurement unit 33 outputs measurement results of the measurement items to the control unit 37. Among these, the altitude can be calculated on the basis of the atmospheric pressure.

Meanwhile, the measurement unit 33 may include a pulse wave sensor that detects pulse waves to measure a pulse rate, an acceleration sensor that detects the user's body motion (specifically, acceleration that acts by the body motion) to measure the user's steps and calorie, and the like, as sensors that measures information regarding the user's body and body motion. In addition, the measurement unit 33 may include an ultraviolet sensor and a temperature sensor as sensors that measure information regarding the surrounding environment.

The driving unit 34 rotates the above-described hand H1 to H6, pointers P1 to P3, and day wheel 271 under the control of the control unit 37. The driving unit 34 includes a stepping motor and a gear train which are provided in accordance with the hands H1 to H6 and the pointers P1 to P3, and a stepping motor and a gear train which rotate the day wheel 271.

The storage unit 35 is constituted by a nonvolatile memory such as a flash memory, and stores various programs and data which are necessary for the operation of the timepiece 1A. For example, as the programs, the storage unit 35 stores a storage program for executing a storage process for storing a measurement result obtained by the measurement unit 33 as a log, and a reference program for executing a reference process to be described later. In addition, the storage unit 35 stores measurement result information including the measurement result obtained by the measurement unit 33 and a measurement date and time which is a date and time when the measurement result is obtained, in association with a log number under the control of the control unit 37. Meanwhile, in this embodiment, the number of logs capable of being stored in the storage unit 35 is 11.

The communication unit 36 communicates with an external apparatus under the control of the control unit 37 to transmit and receive information to and from the external apparatus. For example, the communication unit 36 transmits the measurement result information which is measured by the measurement unit 33 and stored in the storage unit 35 to the external apparatus in accordance with request information received from the external apparatus.

The communication unit 36 can be constituted by a communication module capable of communicating with the external apparatus by a communication system based on a short-range radio communication specification such as IEEE802.15, or a communication system based on IEEE802.16 and a communication specification such as Long Term Evolution (LTE). Meanwhile, an example of the former communication system is Bluetooth (registered trademark).

Figure 3:
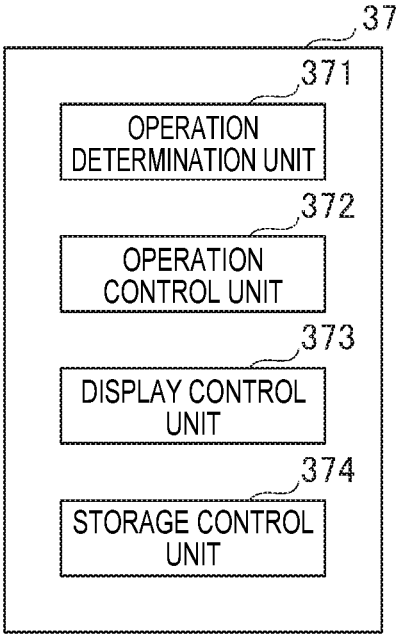
FIG. 3 is a block diagram showing a configuration of a control unit in the first embodiment.

FIG. 3 is a block diagram showing a configuration of the control unit 37.

The control unit 37 is configured to include a computational processing circuit such as a Central Processing Unit (CPU), and controls the overall operation of the timepiece 1A. For example, the control unit 37 performs the correction of the present date and time and hand operation processing for displaying the present date and time by the above-described time display hands H1 to H4, in addition to executing processing based on an operation signal which is input by pressing down the switch SW.

Further, the control unit 37 executes the storage program and the reference program which are stored in the storage unit 35 to perform the storage process and the reference process. For this reason, the control unit 37 includes an operation determination unit 371, an operation control unit 372, a display control unit 373, and a storage control unit 374 as shown in FIG. 3.

The operation determination unit 371 determines the type of operation which is performed by the user on the basis of the operation signal.

For example, in a case where an operation signal based on the input of the switch SWC is input when the present operation mode of the timepiece 1A is the basic mode or the in-flight mode, the operation determination unit 371 determines whether or not an operation of switching the operation mode to the measurement mode has been performed. In addition, for example, when the operation signal based on the input of the switch SWC is input in a case where the present operation mode is the measurement mode, it is determined that a storage operation for storing a log has been performed.

In a case where an operation signal based on the input of the switch SWB is input when the present operation mode of the timepiece 1A is the basic mode or the in-flight mode, the operation determination unit 371 determines whether or not an operation of switching the operation mode to the reference mode has been performed. For example, when the operation signal based on the input of the switch SWB is input in a case where the present operation mode is the reference mode, it is determined that a change operation for changing a log number of measurement result information to be referred to has been performed.

The operation control unit 372 controls the operation of the timepiece 1A autonomously or in accordance with an input operation by the user.

For example, the operation control unit 372 corrects the present date and time which is clocked by the clocking unit 32 on the basis of the received date and time information, in addition to controlling the reception of the date and time information by the reception unit 31. In addition, in a case where the operation determination unit 371 determines that the input operation for changing the operation mode has been performed, the operation control unit 372 changes the operation mode of the timepiece 1A to an operation mode based on the input operation.

The display control unit 373 controls the driving unit 34 to display various pieces of information by the display unit DU. For example, the display control unit 373 displays a battery remaining quantity of secondary battery (not shown) by the remaining quantity display hand H6, in addition to indicating the present operation mode by the mode display hand H5. In a case where the present operation mode of the timepiece 1A is the basic mode, the display control unit 373 displays the present date by the date display unit 27, in addition to indicating the present time by the hands H1 to H4.

Further, in a case where the operation mode of the timepiece 1A is the measurement mode, the display control unit 373 acquires a measurement result (measured value) of the measurement unit 33 and drives the driving unit 34 to indicate the measurement result by the pointers P1 to P3. Meanwhile, the measurement unit 33 can measure a plurality of measurement items as described above, and thus the display control unit 373 displays measurement results of the measurement items, which are selected by the user, by the pointers P1 to P3 but may sequentially switch the measurement items of which the measurement results are to be displayed.

Meanwhile, the operation of the display control unit 373 in a case where the operation mode is the reference mode will be described later in detail.

The storage control unit 374 controls the storage of information by the storage unit 35. For example, when the operation determination unit 371 determines that the storage operation has been performed in a case where the operation mode of the timepiece 1A is the measurement mode, the storage control unit 374 stores measurement result information when the storage operation is performed, in the storage unit 35 as a log.

Figure 4:
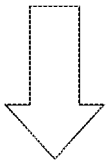
FIG. 4 is a diagram showing a data structure of measurement result information in the first embodiment.

FIG. 4 is a diagram showing a data structure of measurement result information stored in the storage unit 35 by the storage control unit 374. Meanwhile, a log number and measurement result information which are stored in the storage unit 35 in advance are shown at the upper stage in FIG. 4, and a log number and measurement result information after new measurement result information is stored are shown at the lower stage.

Specifically, the storage control unit 374 acquires a measurement result (measured value) of the measurement unit 33 at a timing when the storage operation is performed (a timing when it is determined that the storage operation has been performed) and the present date and time which is clocked by the clocking unit 32. The storage control unit 374 stores the acquired measurement result and present date and time (measurement date and time) in the storage unit 35 as measurement result information as shown in the lower stage in FIG. 4. In this case, the storage control unit 374 sets a log number of the measurement result information as log number 1 indicating the latest measurement result information, and moves up a log number of measurement result information, which is stored in advance, by 1. The storage control unit 374 deletes logs (measurement result information) of log number 12 exceeding the number of logs capable of being held in the storage unit 35. In this manner, a maximum of 11 logs are stored in the storage unit 35.

For this reason, measurement result information of log numbers 1 to 10, which are stored in advance and are shown in the upper stage in FIG. 4, are measurement result information of log numbers 2 to 11, as shown in the lower stage in FIG. 4, when new measurement result information is stored.

Next, in a case where the present operation mode of the timepiece 1A is the reference mode, the display control unit 373 shown in FIG. 3 displays measurement result information of a log number selected (designated) by the user.

Specifically, when an operation of performing switching to the reference mode is performed, the display control unit 373 acquires measurement result information of log number 1 which is the latest measurement result information from the storage unit 35. The display control unit 373 displays a measurement date and time in the measurement result information by the hands H1 to H4 and the date display unit 27, and displays a measurement result by the pointers P1 to P3. In this case, the display control unit 373 displays the log number by the second hand H3.

In addition, when the change operation is performed, the display control unit 373 acquires the measurement result information of the changed log number from the storage unit 35. The display control unit 373 displays a measurement date and time in the acquired measurement result information by the hands H1 to H4 and the date display unit 27 and displays a measurement result by the pointers P1 to P3 as described above, in addition to displaying the changed log number by the second hand H3.

Meanwhile, in a case where an operation mode is the measurement mode or the reference mode, the operation mode is changed to the basic mode by the operation control unit 372 when a predetermined time elapses from the user's final operation. When a change to the basic mode is made, the display control unit 373 displays the present operation mode by the hand H5 in addition to moving the pointers P1 to P3 to the initial positions (respective positions indicating "0") to stop the display of the measurement result and display the present date and time by the time display hands H and the date display unit 27. Meanwhile, the remaining quantity display hand H6 is displayed regardless of the operation mode of the timepiece 1A.

Storage Process

Figure 5:
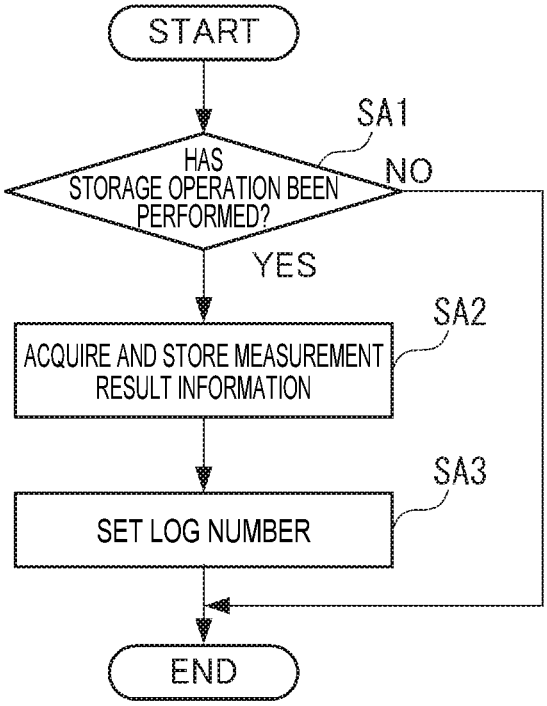
FIG. 5 is a flowchart showing a storage process in the first embodiment.

FIG. 5 is a flowchart showing a storage process performed by the control unit 37.

The control unit 37 reads out a storage program stored in the storage unit 35 to execute the following storage process, in addition to causing the display control unit 373 to perform the display of a measurement result when an input operation for switching an operation mode to a measurement mode is performed and the operation mode of the timepiece 1A is switched to the measurement mode by the operation control unit 372.

In this storage process, first, the operation determination unit 371 of the control unit 37 determines whether or not the storage operation which is an input operation of the switch SWC has been performed, as shown in FIG. 5 (step SA1).

In the determination process of step SA1, when it is determined that the storage operation has not been performed (step SA1: NO), the control unit 37 terminates the storage process.

On the other hand, in the determination process of step SA1, when it is determined that the storage operation has been performed (step SA1: YES), the storage control unit 374 acquires the present date and time at a timing when the storage operation is performed (a timing when it is determined that the storage operation has been performed) from the clocking unit 32 and acquires a measurement result from the measurement unit 33, and stores measurement result information including the acquired present date and time and measurement result in the storage unit 35 (step SA2). Meanwhile, the measurement result acquired by the storage control unit 374 is a measurement result which is presently indicated by the pointers P1 to P3. For this reason, for example, in a case where an altitude among measurement items capable of being measured by the measurement unit 33 is indicated by the pointers P1 to P3, the storage control unit 374 stores a measurement result regarding the altitude in the storage unit 35 in association with the present date and time.

The storage control unit 374 sets log numbers associated with measurement result information which is newly stored in the storage unit 35 and measurement result information which is stored in the storage unit 35 in advance (step SA3).

Specifically, the storage control unit 374 sets the log number of the measurement result information newly stored to be 1 as described above, and moves up the log number of the measurement result information stored in advance by 1. In a case where measurement result information of a log number exceeding the number of logs capable of being stored in the storage unit 35 is present, the measurement result information is deleted from the storage unit 35.

When step SA3 is executed, the control unit 37 terminates the storage process. Meanwhile, the storage process is repeatedly executed while the operation mode is the measurement mode.

Reference Process

Figure 6:
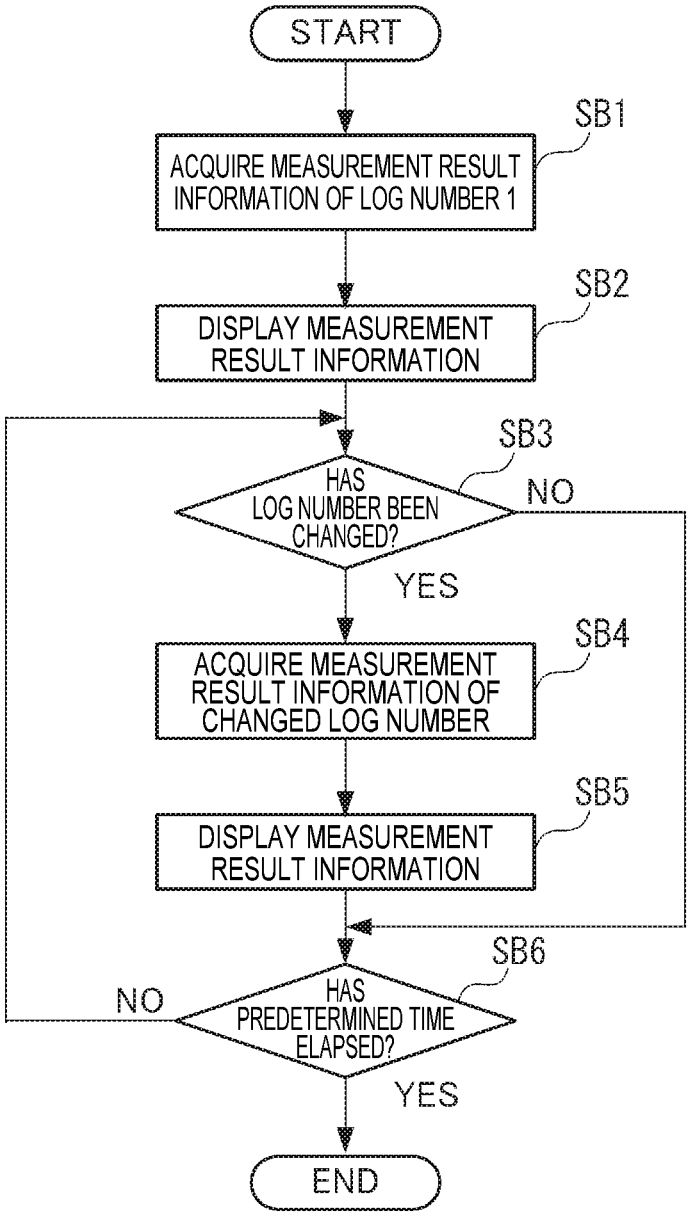
FIG. 6 is a flowchart showing a reference process in the first embodiment.

FIG. 6 is a flowchart showing a reference process performed by the control unit 37.

When an input operation for switching the operation mode to the reference mode is performed and the operation mode of the timepiece 1A is switched to the reference mode by the operation control unit 372, the control unit 37 reads out a reference program stored in the storage unit 35 to execute the following reference process.

In the reference process, first, the display control unit 373 acquires measurement result information of log number 1 which is the latest measurement result information, as shown in FIG. 6 (step SB1).

The display control unit 373 displays the log number and the acquired measurement result information as described above (step SB2).

For example, in a case where a measurement date and time included in the measurement result information of the log number 1 is "9:00 on 31", a log number "1" is indicated by the second hand H3 which is a number hand, "31" is indicated by the date display unit 27, and "9:00" is indicated by the hour hands H1 and H4 and the minute hand H2, as shown in FIG. 1. In a case where a measurement result included in the measurement result information is "2650", "2" which is a numerical value for the high-order first digit is indicated by the pointer P1, "6" which is a numerical value for the high-order second digit is indicated by the pointer P2, and "50" which is the numerical values for the high-order third digit and the fourth digit is indicated by the pointer P3.

After step SB2 is performed, the operation determination unit 371 determines whether or not the change operation for changing a log number has been performed, that is, an operation signal based on an input of the switch SWB has been input, as shown in FIG. 6 (step SB3).

In the determination process of step SB3, when it is determined that the change operation has not been performed (step SB3: NO), the processing proceeds to step SB6 by the control unit 37.

On the other hand, in the determination process of step SB3, when it is determined that the change operation has been performed (step SB3: YES), the display control unit 373 changes a log number to be referred to, in accordance with the number of change operations, to acquire measurement result information of the log number (step SB4).

For example, in a case where it is determined that an input operation for changing a log number has been performed once, the display control unit 373 adds 1 to the log number which is presently referred to. In this case, when the log number which is presently referred to is 1, a log number to be newly referred to is set to be 2. Meanwhile, in a case where it is determined that the input operation has been performed twice, 2 is added to the log number which is presently referred to. When the log number is 1, a log number to be newly referred to is set to be 3.

The display control unit 373 acquires measurement result information based on the log number to be newly referred to from the storage unit 35.

Figure 7:
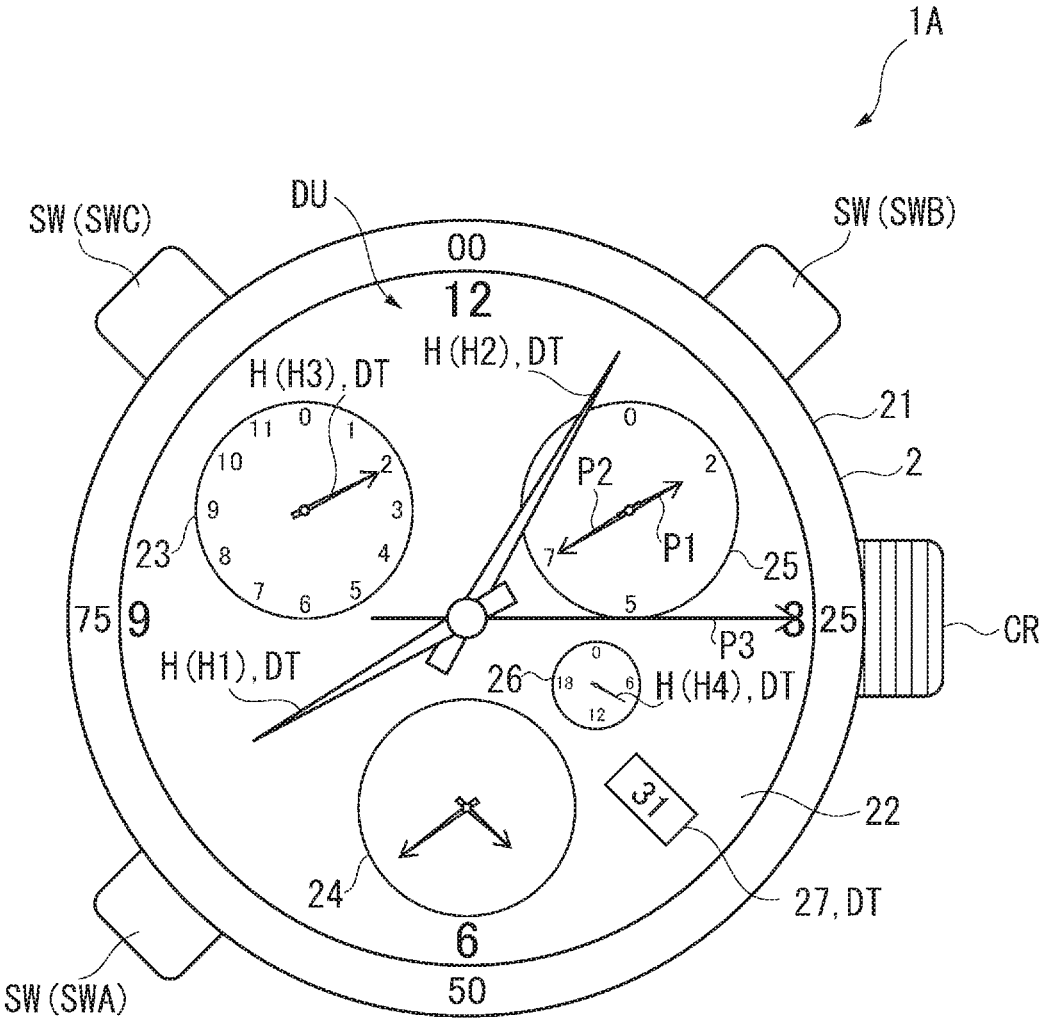
FIG. 7 is a front view showing an electronic timepiece that displays measurement result information of log number 2 in the first embodiment.

FIG. 7 is a front view showing the timepiece 1A that displays measurement result information of log number 2.

After step SB4 is performed, the display control unit 373 displays measurement result information which is newly acquired, similar to the process in step SB3 (step SB5).

For example, in a case where a log number to be newly referred to is 2 and a measurement date and time included in measurement result information of the log number 2 is "8:05 on 31", a log number "2" is indicated by the second hand H3, "31" is indicated by the date display unit 27, and "8:05" is indicated by the hour hands H1 and H4 and the minute hand H2, as shown in FIG. 7. In a case where a measurement result included in the measurement result information is "2725", "2" which is a numerical value for the high-order first digit is indicated by the pointer P1, "7" which is a numerical value for the high-order second digit is indicated by the pointer P2, and "25" which is the numerical values for the high-order third digit and the fourth digit is indicated by the pointer P3.

Thereafter, the processing proceeds to step SB6 by the control unit 37, as shown in FIG. 6.

In step SB6, the operation control unit 372 determines whether or not a predetermined time has elapsed from an input operation which is finally performed, inclusive of the input operation for changing the operation mode to the reference mode (step SB6).

In the determination process of step SB6, in a case where it is determined that a predetermined time has not elapsed (step SB6: NO), the control unit 37 returns the processing to step SB3.

On the other hand, in the determination process of step SB6, in a case where it is determined that a predetermined time has elapsed (step SB6: YES), the control unit 37 terminates the reference process and changes the operation mode of the timepiece 1A to another mode (for example, the basic mode). The display control unit 373 returns the pointers P1 to P3 to the initial positions and corrects a date and time indicated by the time display hands H and the date display unit 27 to the present date and time, in addition to indicating the present operation mode by the mode display hand H5, similar to a case where a change from the measurement mode to the basic mode or the in-flight mode is made.

The reference process is executed by the control unit 37, and thus a measurement result stored at the user's desired timing and a measurement date and time when the measurement result is obtained are displayed by the display unit DU (in detail, the hands H1 to H4, the date display unit 27, and the pointers P1 to P3) together with a log number.

Effects of First Embodiment

According to the timepiece 1A of this embodiment described above, the following effects can be exhibited.

In the reference mode, not only a measurement result obtained by the measurement unit 33 stored in the storage unit 35 in a storage process but also a measurement date and time (including a measurement time) of a timing when the measurement result is obtained can be displayed by the hour hands H1 and H4, the minute hand H2, the date display unit 27, and the pointers P1 to P3 which constitute the display unit DU. Therefore, even when a measurement result stored as a log is confirmed afterward, a user can ascertain a measurement time when the measurement result is obtained.

In the display unit DU, the date and time display unit DT (the hour hands H1 and H4, the minute hand H2, and the date display unit 27) which indicates a measurement date and time and the pointers P1 to P3 indicating a measurement result are separately provided as hands indicating measurement result information. Thereby, it is possible to facilitate the simultaneous ascertainment of the measurement time and the measurement result.

When the storage operation is performed in a case where the operation mode is the measurement mode, the storage control unit 374 stores measurement result information (measurement result and measurement date and time) at a timing when the operation is performed, in the storage unit 35. Accordingly, the storage unit 35 does not need to store all measurement results (every measurement result performed for each predetermined time) which are measured by the measurement unit 33. Therefore, it is possible to reduce the storage capacity of the storage unit 35 and to reduce the manufacturing cost of the electronic timepiece 1A.

The storage control unit 374 stores measurement result information in the storage unit 35, together with a log number (storage number) which indicates the order of storage of measurement result information by the storage unit 35. Accordingly, it is possible to rapidly perform the read-out of the measurement result information from the storage unit 35 on the basis of the log number. For this reason, it is possible to reduce a time from when a log number is designated in the reference mode to when the corresponding measurement result information is read out from the storage unit 35. Therefore, it is possible to reduce a time from when an operation of displaying the measurement result information is performed to when the measurement result information is displayed.

When the storage operation is performed in a case where the operation mode is the measurement mode, the storage control unit 374 stores newly acquired measurement result information in the storage unit 35 together with the latest log number 1, and moves up a log number of measurement result information, which is stored in the storage unit 35 in advance, by 1. Accordingly, it is possible to arrange log numbers in order of storage of measurement result information in the storage unit 35. Therefore, it is possible to efficiently acquire and display the measurement result information based on the corresponding log number in the reference mode in which the log number is designated to display the measurement result information.

When an operation (input operation of the switch SWB) of displaying the measurement result information is performed, the operation control unit 372 switches the operation mode to the reference mode, and the display control unit 373 displays the measurement result information of the designated log number on the display unit DU. Accordingly, it is possible to facilitate the designation of measurement result information that the user desires to refer to.

The display unit DU includes the second hand H3 that functions as a number hand indicating a log number. Accordingly, it is possible to make it easy for the user to confirm a designated log number when measurement result information is displayed in the reference mode. Therefore, it is possible to improve the convenience of the electronic timepiece 1A.

Second Embodiment

Hereinafter, a second embodiment of the invention will be described.

An electronic timepiece according to this embodiment includes the same configuration as that of the electronic timepiece 1A. Here, in the timepiece 1A, the measurement result information and a log number which is a storage number are stored in association with each other, and a user designates a log number in a case where the measurement result information is referred to. On the other hand, in the electronic timepiece according to this embodiment, a user changes a date and time to be displayed by a date and time display unit DT by the crown CR to designate a reference date and time, and a measurement result in which the reference date and time is consistent with a measurement date and time is displayed. In this regard, the electronic timepiece according to this embodiment and the electronic timepiece 1A are different from each other. Meanwhile, in the following description, the same portions or the substantially same portions as the portions described above will be denoted by the same reference numerals and signs, and a description thereof will be omitted.

Figure 8:
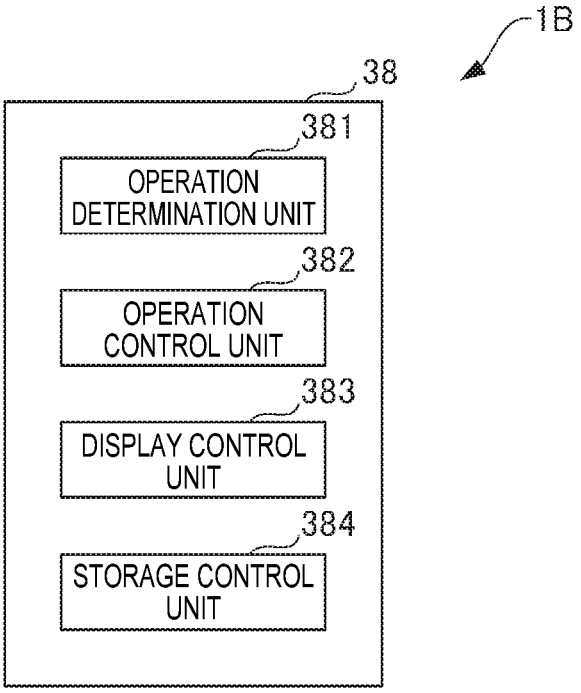
FIG. 8 is a block diagram showing a configuration of a control unit included in an electronic timepiece according to a second embodiment of the invention.

FIG. 8 is a block diagram showing a configuration of a control unit 38 included in an electronic timepiece 1B according to this embodiment.

The electronic timepiece 1B (hereinafter, may be simply referred to as the timepiece 1B) according to this embodiment has the same configuration and function as those of the timepiece 1A except that the timepiece 1B includes the control unit 38 instead of the control unit 37 as shown in FIG. 8.

Meanwhile, a measurement unit 33 included in the timepiece 1B performs measurement at a relatively high frequency, and a measurement result obtained by the measurement unit 33 is stored in a storage unit 35 together with a measurement date and time. In this embodiment, the measurement unit 33 measures atmospheric pressure, altitude, and orientation at a frequency of once a minute. However, the invention is not limited thereto, and a sensor capable of measuring a measurement item other than the above-described measurement items may be provided, and the frequency of measurement can also be appropriately changed.

The control unit 38 controls the operation of the timepiece 1B, similar to the control unit 37, and is configured to include the computational processing circuit and the like. For example, the control unit 38 reads out a program stored in the storage unit 35 to execute a storage process and a reference process to be described later. For this reason, the control unit 38 includes an operation determination unit 381, an operation control unit 382, a display control unit 383, and a storage control unit 384.

The operation determination unit 381 determines the type of input operation by a user, on the basis of an operation signal which is input from the switch SW, similar to the operation determination unit 371.

For example, when an operation signal based on an input of a switch SWC is input in a case where the present operation mode of the timepiece 1B is a basic mode, the operation determination unit 381 determines that an operation of switching the operation mode to a measurement mode has been performed.

When an operation signal based on an input of a switch SWB is input in a case where the present operation mode of the timepiece 1B is the basic mode, the operation determination unit 381 determines that an operation of switching the operation mode to a reference mode has been performed.

The operation control unit 382 controls the operation of the timepiece 1B autonomously or in accordance with an operation determined by the operation determination unit 381, similar to the operation control unit 372.

For example, in a case where the operation determination unit 381 determines that an input operation for changing the operation mode has been performed, the operation control unit 382 changes the operation mode of the timepiece 1B to an operation mode based on the input operation.

The display control unit 383 controls a driving unit 34 and displays various pieces of information by a display unit DU.

For example, in a case where the operation mode is the basic mode, the display control unit 383 drives the driving unit 34 to display the present date and time by time display hands H (H1 to H4) and a date display unit 27, similar to the display control unit 373. In addition, the display control unit 383 displays a present operation mode and a battery remaining quantity by a mode display hand H5 and a remaining quantity display hand H6.

Further, in a case where the operation mode is a measurement mode, the display control unit 383 acquires a measurement result (measured value) obtained by the measurement unit 33 to cause the pointers P1 to P3 to indicate the measurement result. Meanwhile, the measurement unit 33 can measure a plurality of measurement items, but the display control unit 383 causes the pointers P1 to P3 to indicate a measurement result of one measurement item selected by the user, similar to the display control unit 373. However, the invention is not limited thereto, and measurement items of which the measurement results are to be displayed may be sequentially switched as described above. In a case where the operation mode is the measurement mode, the display control unit 383 may display or may not display the present date and time.

Meanwhile, the operation of the display control unit 383 in the reference mode will be described later in detail.

The storage control unit 384 controls the storage of information by the storage unit 35, similar to the storage control unit 374.

For example, the storage control unit 384 stores a measurement result (measured value) measured by the measurement unit 33 and a measurement date and time in the storage unit 35 in association with each other. In this case, the storage control unit 384 may limit a measurement item to be stored in the storage unit 35 to a measurement item (measurement item which is set by the user so as to be displayed in a measurement mode) which is selected by the user, or may store measurement results of all measurement items in the storage unit 35.

The storage of the measurement result and the measurement date and time by the storage control unit 384 is performed as long as the measurement unit 33 is operated. That is, the storage of measurement result information including the measurement result measured by the measurement unit 33 and the measurement date and time is performed in any operation mode of the timepiece 1B as long as the measurement unit 33 functions.

Here, the display control unit 383 acquires a measurement result based on a reference date and time which is set by the user from the storage unit 35 when the operation mode of the timepiece 1B is set to be the reference mode, to display the measurement result by the pointers P1 to P3.

Specifically, when the operation mode is set to be the reference mode, the display control unit 383 acquires a time indicated by the present hour hands H1 and H4 and the minute hand H2 and a date displayed by the date display unit 27, as a reference date and time. The display control unit 383 acquires a measurement result corresponding to the reference date and time from the storage unit 35, and displays the acquired measurement result by the pointers P1 to P3. Meanwhile, the measurement date and time can be displayed by the hour hands H1 and H4, the minute hand H2, and the date display unit 27 which are operated by the user.

Figure 9:
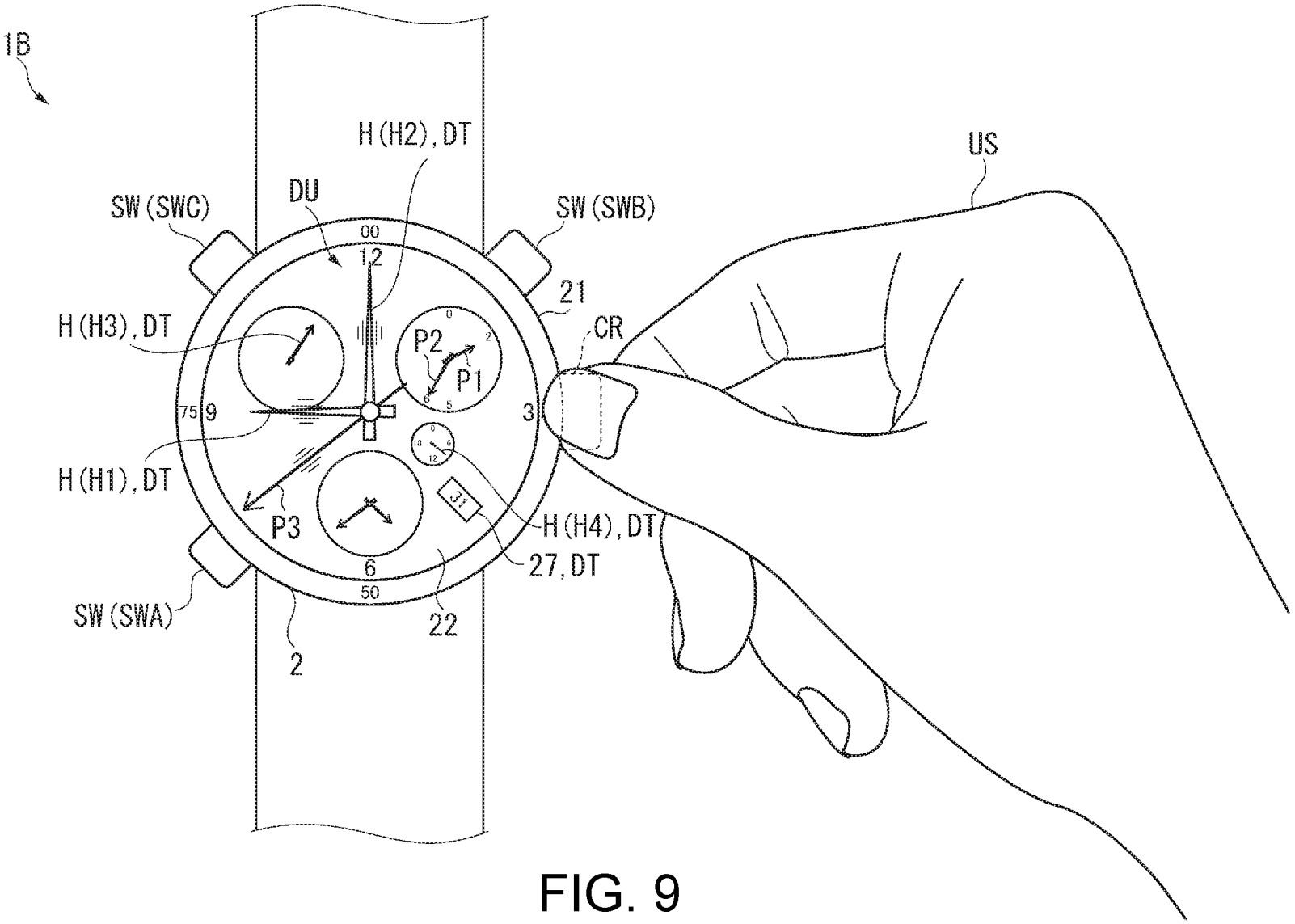
FIG. 9 is a diagram showing the movement of a pointer when a user operates a crown of the electronic timepiece in the second embodiment.

FIG. 9 is a diagram showing the timepiece 1B in which an operation mode is set to be a reference mode. In other words, FIG. 9 is a diagram showing the movement of the pointers P1 to P3 when a user US operates a crown CR to change a reference date and time.

Meanwhile, in the reference mode, a reference date and time is set by the hour hands H1 and H4, the minute hand H2, and the date display unit 27, but an operation of setting the hour and the minute included in the reference date and time is performed by the user operating the crown CR. On the other hand, the measurement unit 33 performs measurement by at least any one of the above-described sensors every minute, as described above.

For this reason, in a case where the operation mode is the reference mode, the display control unit 383 acquires and displays a measurement result in which a reference date and time displayed by a date and time display unit DT and a measurement date and time are consistent with each other, when the hour hands H1 and H4 and the minute hand H2 are moved by the user's operation of the crown CR as shown in FIG. 9. In this manner, since the display control unit 383 displays the measurement result by the pointers P1 to P3, the movement of the hour hands H1 and H4 and the minute hand H2 by the user's operation of the crown CR leads to the movement of the pointers P1 to P3 based on the movement of the hands H1, H2, and H4, and thus the corresponding measurement result is displayed.

Meanwhile, as described above, the measurement unit 33 can measure three measurement items, and the storage unit 35 stores a measurement result of at least one measurement item among the measurement items. For this reason, in a case where the storage unit 35 stores measurement results of a plurality of measurement items, the display control unit 383 may display a measurement result of a measurement item which is selected by the user among the plurality of measurement items. In a case of a configuration in which a measurement result of one measurement item which is set in advance is stored in the storage unit 35, the display control unit 383 may be configured so as to display the measurement result of the one measurement item.

In this embodiment, a reference time included in a reference date and time is set by the positions of the hour hands H1 and H4 and the minute hand H2. That is, a second indicated by the second hand H3 is not included in the reference date and time. However, the invention is not limited thereto, and a second indicated by the second hand H3 may also be included in the reference date and time as long as the position of the second hand H3 can also be changed by the operation of the crown CR or the like.

Storage Process

As described above, the storage control unit 384 stores a measurement result of at least one measurement item, among measurement items capable of being measured by the measurement unit 33, in the storage unit 35 together with a measurement date and time while the measurement unit 33 operates. In this embodiment, the measurement unit 33 measures the three measurement items at a frequency of once a minute, and the storage control unit 384 stores a measurement result of each of the three measurement items in association with a measurement date and time. That is, in the timepiece 1B according to this embodiment, the above-described storage operation for storing measurement result information in the storage unit 35 is not necessary, and a log number is not also necessary.

Reference Process

Figure 10:
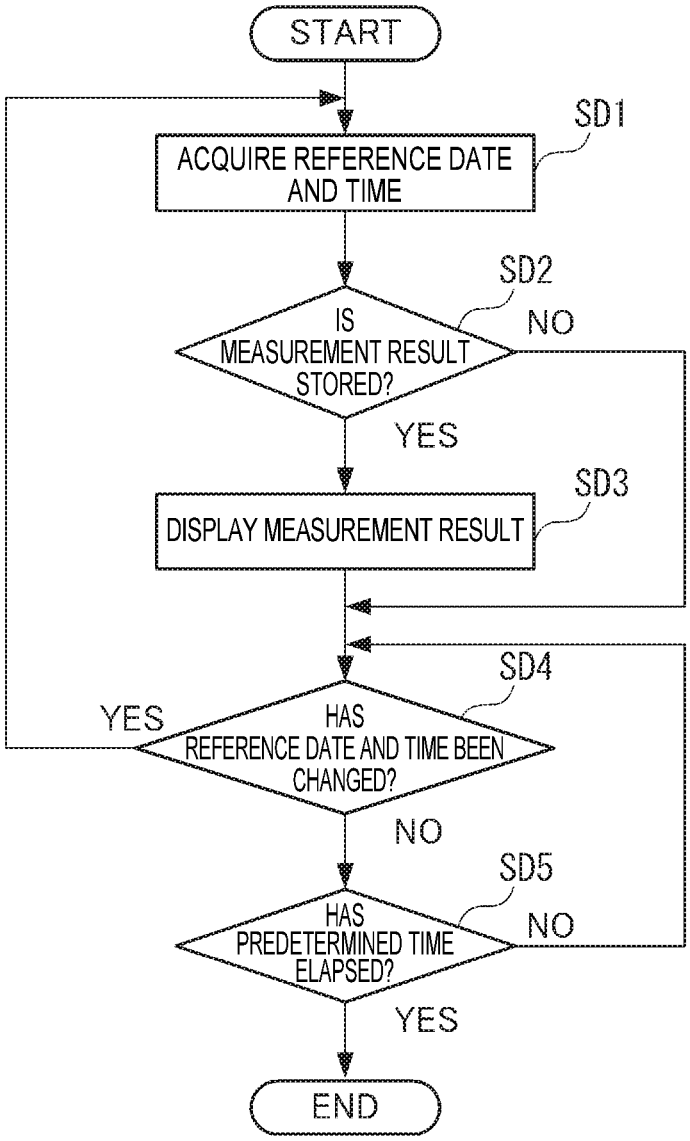
FIG. 10 is a flowchart showing a reference process in the second embodiment.

FIG. 10 is a flowchart showing a reference process executed by the control unit 38.

When the operation mode of the timepiece 1B is switched to the reference mode in accordance with the user's input operation, the control unit 38 reads out a reference program stored in the storage unit 35 to execute the following reference process.

In this reference process, first, the display control unit 383 acquires a reference date and time which is set by the user's operation on the crown CR, as shown in FIG. 10 (step SD1).

Next, the display control unit 383 determines whether or not measurement result information in which a measurement date and time is consistent with the acquired reference date and time is stored (step SD2).

In the determination process of step SD2, when it is determined that the corresponding measurement result information is not stored (step SD2: NO), the control unit 38 shifts the processing to step SD4 without performing the display of a measurement result by the pointers P1 to P3.

On the other hand, in the determination process of step SD2, when it is determined that the corresponding measurement result information is stored (step SD2: YES), the display control unit 383 displays a measurement result included in the measurement result information by the pointers P1 to P3 (step SD3). Thereafter, the control unit 38 shifts the processing to step SD4.

In step SD4, the display control unit 383 determines whether or not an operation of changing a reference date and time has been performed by the user (step SD4). In other words, in step SD4, the display control unit 383 determines whether or not the reference date and time has been changed.

In the determination process of step SD4, when it is determined that the reference date and time has been changed (step SD4: YES), the control unit 38 returns the processing to step SD1.

On the other hand, in the determination process of step SD4, when it is determined that the reference date and time has not been changed (step SD4: NO), the control unit 38 determines whether or not a predetermined time has elapsed from the user's final operation (step SD5).

In the determination process of step SD5, when it is determined that the predetermined time has not elapsed (step SD5: NO), the control unit 38 returns the processing to step SD4.

On the other hand, in the determination process of step SD5, when it is determined that the predetermined time has elapsed (step SD5: YES), the control unit 38 terminates the reference process, and the operation control unit 382 switches the operation mode from the reference mode to the basic mode. The display control unit 383 corrects the date and time indicated by the time display hands H and the date display unit 27 to the present date and time which is clocked by the clocking unit 32.

A measurement result of the reference date and time which is set by the user is displayed by the pointers P1 to P3 through the reference process.

Effects of Second Embodiment

According to the timepiece 1B described above, it is possible to exhibit the following effects in addition to exhibiting the same effects as those of the timepiece 1A.

The measurement unit 33 measures the above-described measurement items at a frequency of once a minute, and the storage control unit 384 stores a measurement result obtained by the measurement unit 33 and a measurement date and time in the storage unit 35 in association with each other. When the user performs a date and time operation (time operation) for changing a date and time indicated by the date and time display unit DT on the crown CR in a case where the operation mode of the timepiece 1B is the reference mode, the display control unit 383 of the control unit 38 acquires measurement result information in which the date and time is consistent with the measurement date and time, and indicates a measurement result included in the measurement result information by the pointers P1 to P3. Accordingly, the date and time indicated by the date and time display unit DT is changed, and thus it is possible to make it easy for the user to ascertain a change in the measurement result. Therefore, it is possible to improve the convenience of the electronic timepiece 1B.

Meanwhile, the timepiece 1B is configured such that a measurement result is displayed in a case where the acquired reference date and time is consistent with the measurement date and time. However, the invention is not limited thereto, and the timepiece 1B may be configured such that a measurement result of a measurement date and time is displayed when a reference date and time is consistent with the measurement date and time in a case where the hands H1, H2, and H4 are advanced, and a measurement result of one measurement date and time is displayed prior to a measurement date and time when the reference date and time is consistent with the measurement date and time in a case where the hands H1, H2, and H4 are returned. That is, in a case where a certain measurement date and time is set to be a first measurement date and time, among measurement dates and times included in a plurality of pieces of measurement result information, and a measurement date and time subsequent to the first measurement date and time is set to be a second measurement date and time, the timepiece 1B may be configured such that a measurement result of the first measurement date and time is displayed when a reference date and time is included in a period (range) between the first measurement date and time and the second measurement date and time. In this case, in a case where there is no second measurement date and time, the second measurement date and time may be replaced with the present date and time. On the other hand, a measurement result of the second measurement date and time may be displayed.

Third Embodiment

Next, a third embodiment of the invention will be described.

An electronic timepiece according to this embodiment has the same configuration as that of the electronic timepiece 1B. Here, in the electronic timepiece 1B, a reference date and time in a reference mode is set by a user operating the crown CR. On the other hand, in the electronic timepiece according to this embodiment, a date and time displayed by a date and time display unit DT can be changed by an input operation of a switch, and a reference date and time is set by the input operation. In this regard, the electronic timepiece according to this embodiment and the electronic timepiece 1B are different from each other. Meanwhile, in the following description, the same portions or the substantially same portions as the portions described above will be denoted by the same reference numerals and signs, and a description thereof will be omitted.

Figure 11:
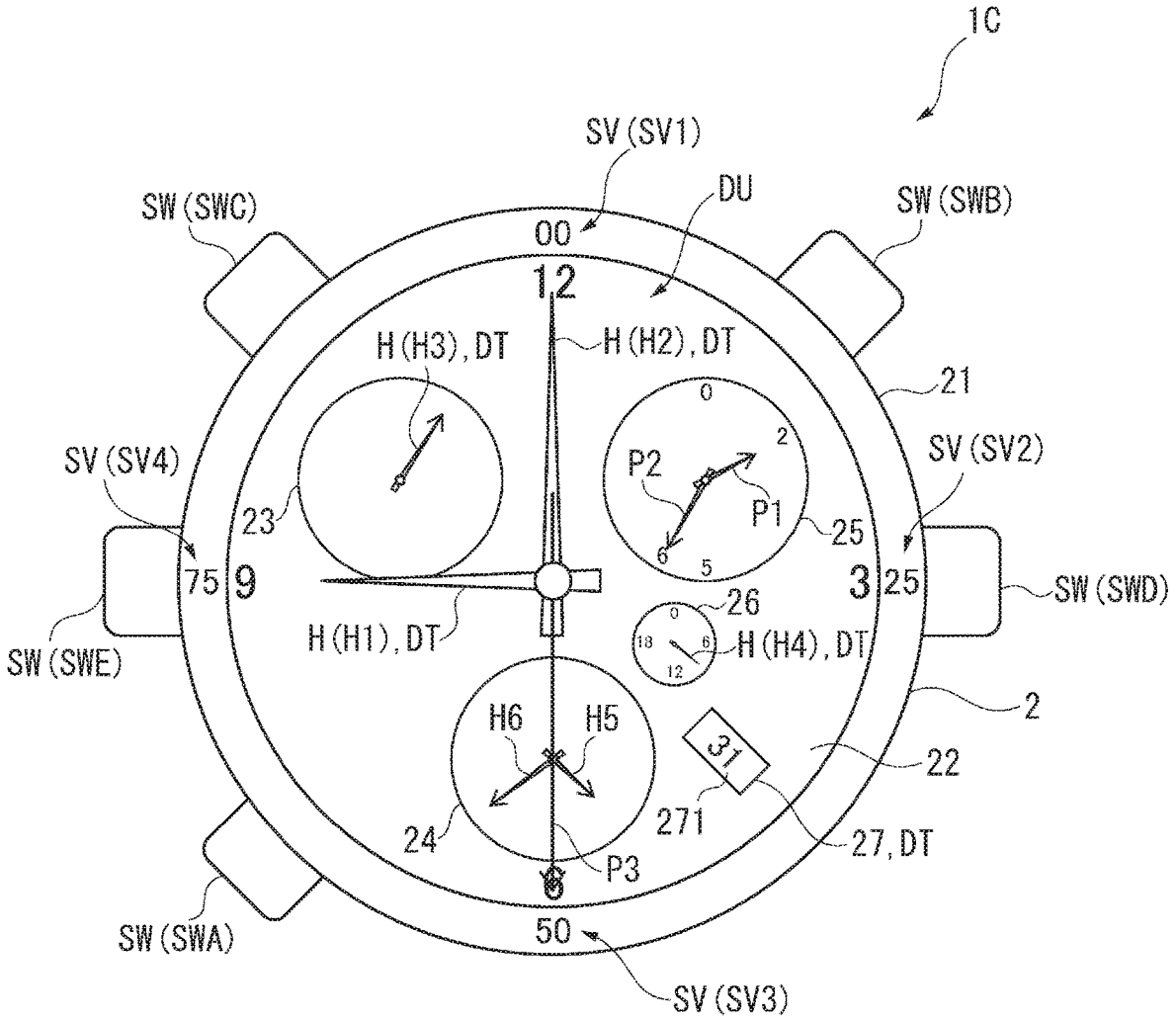
FIG. 11 is a front view showing an electronic timepiece according to a third embodiment of the invention.

FIG. 11 is a front view showing an electronic timepiece 1C according to this embodiment.

The electronic timepiece 1C according to this embodiment includes two switches SW instead of the crown CR as shown in FIG. 11, in addition to having the same configuration as that of the electronic timepiece 1B.

The switches SW (SWD, SWE) function in a case where an operation mode of the electronic timepiece 1C (hereinafter, may be simply referred to as the timepiece 1C) is a basic mode or a reference mode, and rotate hour hands H1 and H4, a minute hand H2, and a day wheel 271 to change a date and time indicated by the hands and the day wheel.

Specifically, a switch SWD rotates the day wheel 271 of a date display unit 27 in a direction in which a date goes back, in addition to rotating the hour hands H1 and H4 and the minute hand H2 in a direction in which a time goes back. On the other hand, a switch SWE rotates the day wheel 271 in a direction in which a date goes ahead, in addition to rotating the hour hands H1 and H4 and the minute hand H2 in a direction in which a time goes ahead.

The rotation of each of the hour hands H1 and H4, the minute hand H2, and the day wheel 271 is performed by the driving unit 34 of which the operation is controlled by the display control unit 383.

Here, the display control unit 383 rotates the hour hands H1 and H4, the minute hand H2, and the day wheel 271 by any one of the following date and time setting methods in a case where the switches SWD and SWE are input (pressed down).

A first date and time setting method is a method in which rotation speeds (movement speeds) of the hands H1, H2, and H4 and the day wheel 271 when the operation mode is the reference mode are set to be higher than rotation speeds when the operation mode is the basic mode. For example, in a case where the operation mode is the reference mode, the rotation speeds are set to be twice the rotation speeds in the basic mode.

A second date and time setting method is a method in which the rotation speeds of the hands H1, H2, and H4 and the day wheel 271 are set to become higher as a date and time indicated goes back to the past. In other words, the second date and time setting method is a method in which the rotation speeds are set to become higher as input times of the switches SWD and SWE increase. For example, when the input time exceeds a predetermined time, a speed higher than the rotation speed by that time is set in a stepwise manner. In this case, when input operations of the switches SWD and SWE are once stopped, the rotation speeds return to the speeds before the change.

A third date and time setting method is a combination of the first date and time setting method and the second date and time setting method. Specifically, the third date and time setting method is a method in which the rotation speeds of the hands H1, H2, and H4 and the day wheel 271 when the operation mode is the reference mode are set to become higher than the rotation speeds in the basic mode, and the rotation speeds are set to be high in accordance with input times (pressing-down times) of the switches SWD and SWE.

Among these, the driving unit 34 rotates the hands H1, H2, and H4 and the day wheel 271 under the control of the display control unit 383 to set a reference date and time in the reference process by any one date and time setting method.

The control unit 38 of the timepiece 1C executes the same storage process as that of the timepiece 1B, and the storage control unit 384 of the control unit 38 stores a measurement result obtained by the measurement unit 33 in the storage unit 35 together with a measurement date and time.

In addition, the control unit 38 executes the same reference process as that of the timepiece 1B, and the display control unit 383 indicates a measurement result based on a reference date and time, which is changed by the switches SWD and SWE, by the pointers P1 to P3.

Effects of Third Embodiment

According to the timepiece 1C described above, it is possible to exhibit the following effects in addition to exhibiting the same effects as those of the timepiece 1B.

In a case where any one of the first and third date and time setting methods is adopted, the driving unit 34 moves the hour hands H1 and H4, the minute hand H2, and the day wheel 271 at a movement speed higher than a movement speed in the basic mode under the control of the display control unit 383 in a case where an operation (input operations of the switches SWD and SWE) of changing a display date and time is performed when the operation mode of the timepiece 1C is the reference mode. Specifically, the movement speed of the minute hand H2 in the reference mode is set to be twice the movement speed in the basic mode, and thus the movement speeds of the hour hands H1 and H4 and the day wheel 271 are set to be twice. That is, in the reference mode, a display date and time is changed at a speed twice the speed in the basic mode.

Accordingly, it is possible to rapidly change the display date and time, as compared with a case where the display date and time is changed by turning the crown CR.

In addition, when the operation mode is the reference mode, the change of a display date and time, that is, a reference date and time is performed at a higher speed than that in the basic mode. For this reason, it is possible to make it easy to ascertain a change in a measurement result based on the reference date and time.

In a case where any one of the second and third date and time setting methods is adopted, the driving unit 34 increases the movement speeds (rotation speeds) of the hour hands H1 and H4, the minute hand H2, and the day wheel 271 under the control of the display control unit 383 so that the speed of change of the display date and time, that is, the reference date and time increases as the display date and time goes back to the past, in a case where an operation of changing the display date and time is performed when the operation mode of the timepiece 1C is the reference mode. Specifically, the speed of change of the display date and time is increased by increasing the rotation speed of the minute hand H2 as input times of the switches SWD and SWE increase. Meanwhile, the hour hands H1 and H4 are moved by an hour when the minute hand H2 is moved by an hour, and the day wheel 271 is moved by a day when the hour hands H1 and H4 are moved by a day.

Accordingly, in a case where a relatively old measurement result is referred to, it is possible to make it easy to match the reference date and time to a measurement date and time associated with the measurement result. Therefore, it is possible to improve the convenience of the electronic timepiece 1C.

Modification of Embodiment

The invention is not limited to the above-described embodiments, and modifications, improvements, and the like in a range in which an object of the invention can be accomplished are included in the invention.

In the above-described embodiments, when a measurement result obtained by the measurement unit 33 is stored in the storage unit 35, a measurement date and time which is a date and time when the measurement result is obtained is stored in association with the measurement result. Here, the measurement date and time may not be the present date and time which is clocked by the clocking unit 32. For example, the measurement date and time may be acquired on the basis of a display state (the position of each hand) of the date and time display unit DT and may be stored in association with a measurement result. Further, the positions (angles) of the hour hands H1 and H4 and minute hand H2 and the position (angle) of the day wheel 271 at a timing when the measurement result is obtained may be stored as information indicating the measurement date and time.

Further, a configuration may be adopted in which date and time information is acquired by the reception unit 31 at a timing when the measurement result is stored, and the date and time information is stored as the measurement date and time.

In addition, the electronic timepiece may be configured to store a measurement result and a measurement time and to display the stored measurement result and measurement time by the display unit DU. In this case, the date display unit 27 may not be provided, and a date may not be determined.

In the above-described embodiments, the hour hands H1 and H4 and the minute hand H2 indicating a measurement time in a measurement date and time and the pointers P1 to P3 indicating a measurement result are separately provided. However, the invention is not limited thereto, and a hour hand may be used as one of pointers, for example, in a case where the electronic timepiece is configured to be capable of storing only measurement results for the last one hour.

In a case where a log number is not displayed as in the timepieces 1B and 1C described in the second and third embodiments, the second hand H3 may be used one of pointers indicating a measurement result.

In the first embodiment, in a case where the storage operation is performed when the operation mode is the measurement mode, the storage control unit 374 stores the measurement result information in the storage unit 35 together with a log number. However, the invention is not limited thereto, and the storage control unit 374 may be configured to store a measurement result and a measurement date and time in the storage unit 35 at all times, similar to the storage control unit 384 of the electronic timepieces 1B and 1C according to the second and third embodiments, or may be configured to store measurement result information at a timing when a storage operation is performed in a case where the storage operation is performed, in association with a log number.

The electronic timepieces 1A, 1B, and 1C according to the respective embodiments include the communication unit 36 that transmits measurement result information to an external apparatus in accordance with request information received from the external apparatus. However, the invention is not limited thereto, and the communication unit 36 may not be provided.

In the first embodiment, the storage unit 35 is configured to be capable of storing 11 pieces of measurement result information as logs, and a configuration is adopted in which the oldest measurement result information is deleted in a case where newly acquired measurement result information is stored. That is, the storage unit 35 stores measurement result information by a First In First Out (FIFO) system. However, the invention is not limited thereto, and the storage control unit 374 may be configured not to store a determined number or more of pieces of measurement result information in the storage unit 35. In this case, the user may select measurement result information to be erased.

In addition, a log number corresponding to the latest measurement result information is set to be "1", and a log number of measurement result information stored in the storage unit 35 in advance becomes larger as the measurement result information becomes older. However, the invention is not limited thereto, and a configuration may also be adopted in which a log number indicating the latest measurement result information is set to be the number of pieces of measurement result information capable of being stored in the storage unit 35, and a log number of measurement result information stored in the storage unit 35 in advance becomes smaller as the measurement result information becomes older. In this case, when measurement result information is newly stored, a log number of measurement result information stored in advance may be moved down.

In the first embodiment, measurement result information of a log number designated by the user is displayed. However, the invention is not limited thereto, and a configuration may also be adopted in which the display control unit 373 displays measurement result information for each predetermined time (for example, every three seconds) in order of log numbers when the operation mode is changed to the reference mode.

In the first embodiment, the timepiece 1A is configured such that the switch SWC is a storage operation unit that receives a storage operation for storing a log in the storage unit 35. However, the invention is not limited thereto, and the storage operation unit may be another switch such as the switch SWA or SWB, or may be the crown CR. For example, in a case where the timepiece includes a sensor (an acceleration sensor, a gyro sensor, or the like) which detects the movement of the timepiece, a configuration may be adopted in which the storage control unit stores measurement result information including a measurement result and a measurement date and time in the storage unit in a case where it is determined that the user has performed a predetermined operation, on the basis of a detection result obtained by the sensor. This is the same as in an operation of displaying measurement result information, and is also the same as in the storage operation and the display operation in the second and third embodiments.

In the first embodiment, when the switch SWC is input when the operation mode is the measurement mode, the timepiece 1A stores measurement result information during the input of the switch SWC. However, the invention is not limited thereto, and a configuration may be adopted in which measurement result information is stored as a log in a case where a predetermined operation is performed on the timepiece 1A when the measurement unit 33 functions in any operation mode. That is, an operation mode when storing the measurement result information as a log does not matter.

In the second and third embodiments, a configuration has been adopted in which the minute hand H2 is rotated in accordance with a rotation operation of the crown CR and input operations of the switches SWD and SWE, and the displays of the hour hands H1 and H4 and the date display unit 27 are changed. However, the invention is not limited thereto, and a configuration may be adopted in which the hour hands H1 and H4, the minute hand H2, or the day wheel 271 is rotated in a direction in which a time goes back to the past when the operation modes of the electronic timepieces 1B and 1C are changed to the reference mode, and a measurement result in which a date and time displayed by the hands and the day wheel is set to be a measurement date and time is displayed by the pointers P1 to P3. For example, in a case where the measurement unit 33 performs measurement at a frequency of once an hour, a configuration may be adopted in which only the hour hands H1 and H4 are rotated in accordance with a rotation operation of the crown CR and input operations of the switches SWD and SWE, and a measurement result in which the hour in the hour and the minute in a reference date and time is consistent with the hour in the hour and the minute in a measurement date and time is displayed. In a case where the measurement unit 33 performs measurement at a frequency of once a day, a configuration may be adopted in which only the day wheel 271 is rotated in accordance with a rotation operation of the crown CR and input operations of the switches SWD and SWE, and a measurement result in which the date in the reference date and time is consistent with the date in the measurement date and time is displayed.

In the second and third embodiments, the measurement unit 33 measures atmospheric pressure, altitude, and orientation at intervals of once a minute, and the storage control unit 384 stores measurement results thereof in the storage unit 35 in association with a measurement date and time. However, the invention is not limited thereto, and the cycle of measurement of the measurement unit 33 and the cycle of storage in the storage unit 35 by the storage control unit 384 can be appropriately changed. For example, the measurement unit 33 may perform measurement at a frequency of once an hour.

In addition, the storage control unit 384 may be configured to calculate an average value of measured values at predetermined intervals and to store the measured value in the storage unit 35 as a measurement result for each predetermined interval. For example, a configuration may be adopted in which the measurement unit 33 measures a predetermined measurement item at intervals of four seconds, and the storage control unit calculates an average value of a predetermined measurement item for one minute and stores the average value in the storage unit every minute as a measurement result.

In the above-described embodiments, the display unit DU includes the hour hand H1 which is a 12-hour hand and the hour hand H4 which is a 24-hour hand. However, the invention is not limited thereto, and the electronic timepiece may be configured to include only one of the hour hands H1 and H4.

In addition, the design (for example, the layout of a small window) of the dial 22 can be appropriately changed.

What is claimed is:

1. An electronic timepiece comprising:

a measurement unit comprising a sensor configured to measure a predetermined measurement item;

a storage unit comprising memory configured to store measurement result information in which a measurement result obtained by the measurement unit is associated with a measurement time when the measurement result is obtained; and a display including a hour hand, a minute hand and a pointer separately, wherein the display is configured to simultaneously display (1) the measurement result by the pointer and (2) the measurement time by the hour hand and the minute hand such that the measurement result and the measurement time are displayed simultaneously.

2. The electronic timepiece according to claim 1, wherein the hands include a hour hand and a minute hand which indicate the measurement time, and a pointer which is provided separately from the hour hand and the minute hand and indicates the measurement result.

3. The electronic timepiece according to claim 2, further comprising:

a control unit which indicates the measurement result associated with the measurement time by the pointers in a case where a time indicated by the hour hand and the minute hand is consistent with the measurement time stored in the storage unit, when a time operation for changing positions of the hour hand and the minute hand is performed.

4. The electronic timepiece according to claim 3, further comprising:

a driving unit which moves the hour hand and the minute hand in accordance with the time operation, wherein the electronic timepiece is configured to be switching an operation mode to a reference mode in which the measurement result information stored in the storage unit is referred to and a basic mode in which a present time is displayed, and wherein the driving unit moves the hour hand and the minute hand at a movement speed higher than movement speeds of the hour hand and the minute hand in a case where the time operation is performed in the basic mode, when the time operation is performed in the reference mode being the operation mode.

5. The electronic timepiece according to claim 3, further comprising:

a driving unit which moves the hour hand and the minute hand in accordance with the time operation, wherein the driving unit increases movement speeds of the hour hand and the minute hand as the time indicated by the hour hand and the minute hand goes back to the past.

6. The electronic timepiece according to claim 1, further comprising:

a storage control unit which stores the measurement result information in the storage unit when a storage operation for storing the measurement result information is performed.

7. The electronic timepiece according to claim 6, wherein the storage control unit stores the measurement result information in the storage unit together with a storage number indicating the order of storage of the measurement result information by the storage unit.

8. The electronic timepiece according to claim 7, wherein the storage control unit stores the measurement result information, which is newly acquired, in the storage unit together with the latest storage number when the storage operation is performed, and performs any one of moving-up and moving-down of the storage number associated with the measurement result information which is stored in the storage unit in advance.

9. The electronic timepiece according to claim 8, further comprising:

a display control unit which displays the measurement result information associated with the storage number, which is designated through the display operation, on the display unit when a display operation for displaying the measurement result information is performed.

10. The electronic timepiece according to claim 9, wherein the display unit includes a number hand indicating the storage number.

11. The electronic timepiece according to claim 7, further comprising:

a display control unit which displays the measurement result information associated with the storage number, which is designated through the display operation, on the display unit when a display operation for displaying the measurement result information is performed.

12. The electronic timepiece according to claim 11, wherein the display unit includes a number hand indicating the storage number.

13. A method of controlling an electronic timepiece, the method comprising:

measuring a predetermined measurement item;

acquiring a measurement time when a measurement result is obtained;

storing measurement result information in which the measurement result and the measurement time are associated with each other;

applying a storage number indicating the order of storage to the measurement result information;

providing a display comprising a hour hand, a minute hand and a pointer separately; and simultaneously displaying (1) the measurement result by the pointer and (2) the measurement time by the hour hand and the minute hand such that the measurement result and the measurement time are displayed simultaneously, on the basis of the measurement result information associated with the storage number in a case where the storage number is selected.

* * * * *